United States Patent [19]

Ballhause et al.

[11] Patent Number: 4,763,635

[45] Date of Patent: Aug. 16, 1988

[54] DISCHARGE SYSTEM FOR INTRODUCING VOLATILIZED FUEL INTO AN INTERNAL COMBUSTION ENGINE

[75] Inventors: Lutz Ballhause, Waiblingen; Siegfried Fehrenbach, Markgröningen; Kurt Herbst, Burgstetten; Erwin Krimmer, Plüderhausen; Wolfgang Schulz, Bietigheim-Bissingen, all of Fed. Rep. of Germany

[73] Assignee: Robert Bosch GmbH, Stuttgart, Fed. Rep. of Germany

[21] Appl. No.: 828,473

[22] Filed: Feb. 12, 1986

[30] Foreign Application Priority Data

May 30, 1985 [DE] Fed. Rep. of Germany ..... 3519292

[51] Int. Cl.[4] ..... F02M 39/00

[52] U.S. Cl. ..... 123/520; 123/518; 251/129.16; 251/129.21

[58] Field of Search ..... 123/518, 519, 520, 521, 123/458; 251/129.21, 129.05, 129.16; 267/56

[56] References Cited

U.S. PATENT DOCUMENTS

| | | | |
|---|---|---|---|
| 3,422,850 | 1/1969 | Caldwell | 251/129.16 |
| 3,961,644 | 6/1976 | Eckert | 251/129.21 |
| 4,149,504 | 4/1979 | Walters | 123/520 |
| 4,196,751 | 4/1980 | Fischer | 251/129.16 |
| 4,275,697 | 6/1981 | Stoltman | 123/520 |
| 4,304,391 | 12/1981 | Yamguehi | 251/129.05 |
| 4,378,383 | 3/1982 | Iritani et al. | 123/518 |
| 4,614,327 | 9/1986 | Valbjorn | 251/129.16 |

FOREIGN PATENT DOCUMENTS

| | | | |
|---|---|---|---|
| 0080115 | 6/1980 | Japan | 251/129.21 |
| 0214084 | 12/1983 | Japan | 251/129.16 |
| 2124342 | 2/1984 | United Kingdom | 251/129.16 |

*Primary Examiner*—Carl Stuart Miller

*Attorney, Agent, or Firm*—Edwin E. Greigg

[57] ABSTRACT

A discharge system is proposed which serves to introduce volatilized fuel into an intake tube of an internal combustion engine. The discharge system includes a discharge regulation valve, which on one side is located at an outlet line of an absorber element that emits volatilized fuel and on the other side is located at an outflow line which leads to the intake tube downstream of a throttle device. The discharge regulation valve includes a bottom portion and a cover between which one end of a leaf spring is firmly fastened. The other end of the leaf spring is loosely guided in a gap between the bottom portion and the cover. An armature is joined to the leaf spring and a valve closing body is secured to the armature remote from the leaf spring. A core is secured on a magnet housing disposed in the bottom portion and has a through conduit, which at one end terminates at a valve seat. An electromagnetic coil is disposed in the magnet housing and is triggerable in a clocked manner by an electronic control unit in accordance with engine operating characteristics. The spacing between the valve seat and the valve closing body adjusts automatically in accordance with the pressure difference at the valve seat.

10 Claims, 2 Drawing Sheets

DISCHARGE SYSTEM FOR INTRODUCING VOLATILIZED FUEL INTO AN INTERNAL COMBUSTION ENGINE

BACKGROUND OF THE INVENTION

The invention is based on a discharge system for volatilized fuel as generally defined hereinafter. Such discharge systems are used to carry fuel components that have been volatilized from the fuel sources of the engine, for instance the fuel tank or a carburetor float chamber, to the engine where they can be burned, rather than into the open air. A discharge system is already known in which the introduction of volatilized fuel via the delivery system is interrupted during engine idling, to prevent excessive enrichment of the fuel-air mixture, which would cause undesirable engine operation. To this end, a pneumatic control line is connected to the delivery regulation valve and leads to the intake tube in the immediate vicinity of the throttle valve. An electromagnetic switching valve is disposed in the control line and opens the control line to the atmosphere whenever the temperature in the fuel container becomes too high. This kind of discharge system is not only expensive, but it does not allow optimal regulation, in accordance with engine operating characteristics, of the amount of volatilized fuel fed to the engine.

OBJECT AND SUMMARY OF THE INVENTION

The discharge system according to the invention has the advantage over the prior art that in a simple manner, the discharge regulation valve is automatically adapted to engine operating conditions, so that during engine idling a small flowthrough cross section is available at the discharge regulation valve, while at full-load engine operation this flowthrough cross section is large; furthermore, by means of electromagnetic intervention at the discharge regulation valve, the amount of volatilized fuel supplied to the engine can be regulated directly, in a desired manner, in accordance with operating characteristics of the engine.

A particular advantage of the invention is that the spring is embodied as a leaf spring and is fastened at one end between a cover and a bottom portion of the discharge regulating valve, while its other end is loosely guided between the cover and the bottom portion. A further particularly advantageous feature is that the electromagnet coil of the discharge regulation valve is triggerable in a clocked manner.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
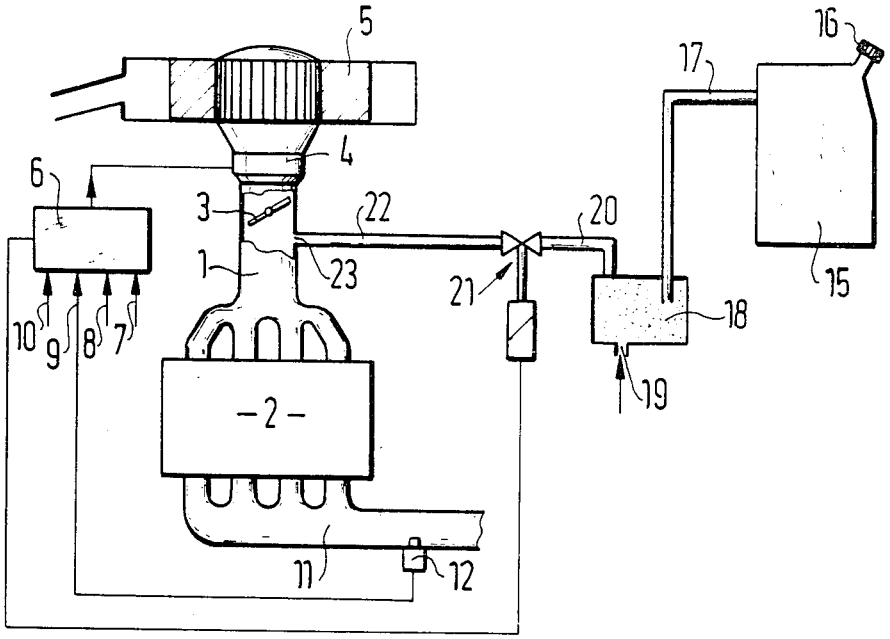
FIG. 1 shows a discharge system in simplified form, intended for introducing volatilized fuel into an internal combustion engine via a discharge regulation valve embodied in accordance with the invention.

FIG. 1 shows an intake tube 1 of a mixture-compressing internal combustion engine 2 with externally supplied ignition; in the intake tube 1, in a known manner, there is a throttle device in the form of a throttle valve 3, and upstream from that there is a fuel supply system 4, such as a carburetor or electronic fuel injection system. Upstream of the fuel supply system, air flows into the intake tube 1 via an air filter 5. The fuel supply system 4 may be triggered in a known manner by an electronic control unit 6; the electronic control unit is supplied with operating characteristics of the engine, such as rpm 7, temperature 8, exhaust gas composition 9, throttle valve position 10, and so forth, all having been converted into electrical variables. The exhaust gas composition of the engine is detected by means of an exhaust gas measuring sensor 12 disposed in an exhaust gas line 11 of the engine; this sensor 12 may for instance be an oxygen sensor, also known as a lambda sensor.

The supply of fuel to the engine is effected from a fuel tank 15 serving as a fuel source. The fuel tank 15 is tightly closed by a tank cover 16. In many countries, regulations require that readily volatilized components evaporating out of the fuel must not be vented into the open air. Volatilized fuel can therefore be carried away from the fuel tank 15 via an inflow line 17 and delivered in a known manner to an absorber element, such as an activated charcoal filter 18. The activated charcoal filter 18 likewise communicates with the atmosphere, via a vent opening 19. An outlet line 20 leads from the activated charcoal filter 18 to a discharge regulation valve 21, which is electromagnetically actuatable. The delivery regulation valve 21 is triggered by the electronic control unit 6. In its open state, the discharge regulation valve 21 joins the outlet line 20 leading from the activated charcoal filter 18 to an outflow line 22, which discharges via an opening 23 into the intake manifold 1 of the engine downstream of the throttle valve 3.

Figure 3:
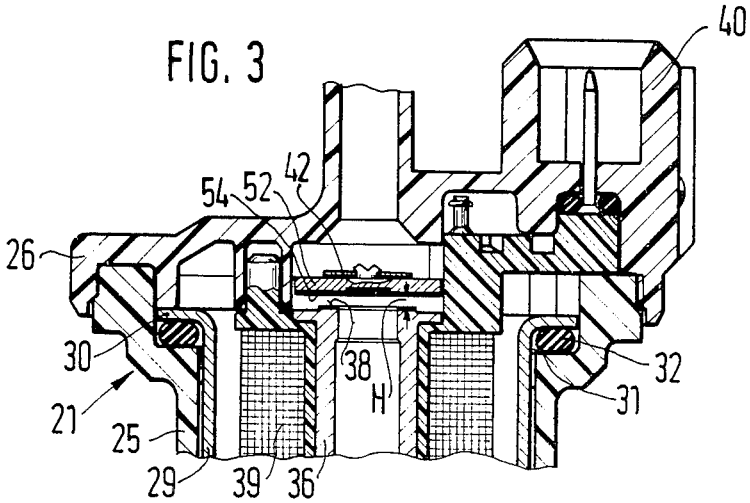
FIG. 3 is a sectional view taken along the line III—III of FIG. 2.
Figure 2:
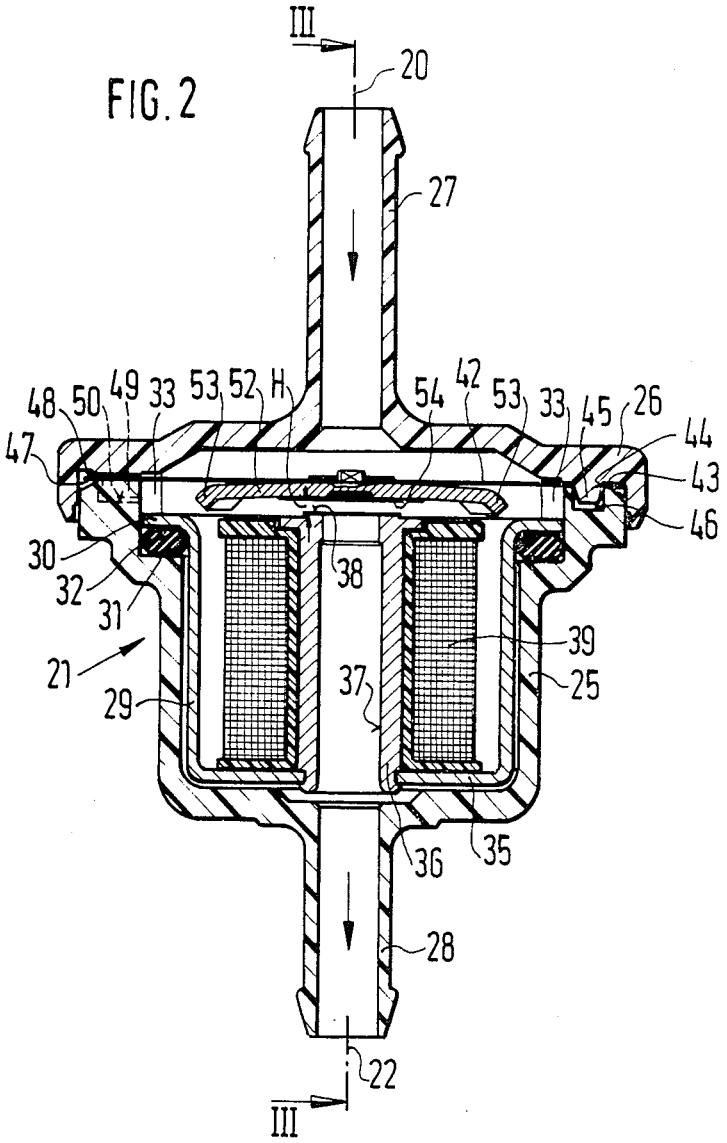
FIG. 2 shows a discharge regulation valve embodied in accordance with the invention in a sectional view.

In FIGS. 2 and 3, the discharge regulation valve 21 is shown in cross section. The discharge regulation valve 21 has a bottom portion 25 and a cover 26, both of them being made from plastic and welded tightly to one another ultrasonically. The cover 26 has an inflow pipe 27 communicating with the outlet line 20 of the activated charcoal filter 18, and the bottom portion 25 has an outflow pipe 28 communicating with the outflow line 22. A cup-shaped magnet housing 29 made of magnetic material is disposed in the cup-shaped bottom portion 25 and protrudes with a collar 30 beyond a sealing step 31 of the bottom portion 25. A sealing ring 32 is disposed between the collar 30 and the sealing step 31. Extensions 33 of the cover 26 engage the collar 30 and press it toward the sealing step 31 of the bottom portion 26, thereby clamping down on the sealing ring 32. A core 36 is secured coaxially to the bottom 35, remote from the collar 30, of the cylindrical magnet housing 29. The core 36 has a conduit 37 extending all the way through it. The end of the through conduit 37 facing the bottom 35 is open toward the outflow pipe 28, while the other end of the through conduit 37 terminates at a valve seat 38 embodied on the core 36. An electromagnet coil 39 is disposed in such a manner as to surround the core 36 in the magnet housing 29, and this coil 39 is triggerable by the electronic control unit 6. To this end, an electric plug 40 (see FIG. 3) is disposed on the cover 26. A rectangular leaf spring 42 is disposed between the facing horizontal contact surfaces of the bottom portion 25 and cover 26. At one end i.e., 43, the leaf spring 42 has a retention opening 44. The end 43 of the leaf spring 42 is fastened firmly between the bottom portion 25 and the cover 26, and additionally a holder tang 45, for instance formed on the cover 26, extends through the retention opening 44 of the leaf spring 42 and is received in an opening 46 of the bottom portion 25. The other end 47 of the leaf spring 42 is loosely guided in a gap 48 which is provided between the bottom portion 25 and the cover 26. To guide the end 47 of the leaf spring 42 laterally, guide protrusions 49 are provided in the lid 26 to the right and left of the leaf spring; these protrusions 49 protrude into guide grooves 50 of the bottom portion 25. The guide protrusion 49 and guide groove 50 are shown in dashed lines. On the side of the leaf spring facing the valve seat 38, an armature 52 is secured to the leaf spring 42, for instance by riveting. The armature 52 is disk-shaped by way of example and has leading ends 53 on its circumference which are curved toward the magnet housing 29. A valve closing body 54 which is made of rubber or plastic, for example, is joined to the armature 52 and is adapted to face the valve seat 38. In the non-excited state of the electromagnet coil and when the engine is not in operation, the armature 52 is retained in a position in which a stroke spacing H exists between the valve seat 38 and the valve closing body 54.

The electromagnet coil 39 is advantageously triggered in a clocked manner by the electronic control unit 6; that is, it is triggered with a variable ratio between the duration of the open position and that of the closed position of the discharge regulation valve. This electromagnetic triggering of the discharge regulation valve 21 has superimposed on it the automatic regulation of the spacing between the valve seat 38 and the valve closing body 54 effected by an appropriate embodiment of the leaf spring 42 in accordance with the pressure difference upstream and downstream of the valve seat 38, such that during engine idling the spacing between the valve seat 38 and the valve closing body 54 is virtually zero, while as the load increases this spacing is steadily enlarged, and at full load it is virtually as large as the stroke spacing H.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A discharge system for introducing volatilized fuel via an absorber element, a discharge regulation valve having a bottom portion and an outflow line, into an intake tube of an internal combustion engine downstream of a throttle device, said discharge regulation valve being disposed in the outflow line downstream of said absorber element, said discharge regulation valve further including a valve seat that is closable by a valve closing body counter to a spring, said discharge regulation valve having an electromagnetic coil arranged to encircle a hollow core, said hollow core adapted to communicate at one end with said outflow line and at the other end said hollow core terminates at a valve seat, an armature provided with a valve closing body in proximity to said electromagnetic coil and said valve seat, wherein atmospheric pressure prevails on both sides of said armature and in a current-free state of said electromagnetic coil as well as when said internal combustion engine is not in operation, said valve closing body is retained by said spring at a stroke spacing with respect to said valve seat, while when said internal combustion engine is operational the spacing between said valve closing body and said valve seat can be reduced counter to said spring in accordance with the pressure difference upstream and downstream of said valve seat in such a manner that the spacing between said valve seat body and said valve seat is virtually as large as the stroke spacing at full load of said internal combustion engine and is virtually zero during idling of said internal combustion engine.

2. A discharge system as defined by claim 1, in which said spring is embodied as a leaf spring.

3. A discharge system as defined by claim 2, in which said spring is a leaf spring, said leaf spring has a longitudinal extent including opposite end portions at least one of said end portions being in positive engagement with a cover means that is secured to said bottom portion of said discharge regulation valve.

4. A discharge system as defined by claim 3, in which said leaf spring has another end portion which is in limited sliding engagement with said cover means.

5. A discharge system as defined by claim 3, in which guide means in said cover means control lateral movement of said leaf spring.

6. A discharge system as defined in claim 5, in which said guide means cooperate with groove means in said bottom portion of said discharge regulation valve.

7. A discharge system as defined by claim 3, in which said leaf spring is secured to said armature remote from said valve closing body.

8. A discharge system as defined by claim 7, in which said armature is disk-shaped.

9. A discharge system as defined by claim 7, in which said cover means and said bottom portion are made of plastic and are welded together ultrasonically.

10. A discharge system as defined by claim 1, in which said electromagnetic coil of said discharge regulation valve is triggerable in a clocked manner by an electronic control unit.

* * * * *